US009822950B2

(12) United States Patent
Meerbeek et al.

(10) Patent No.: US 9,822,950 B2
(45) Date of Patent: Nov. 21, 2017

(54) LIGHTING SYSTEM

(71) Applicant: PHILIPS LIGHTING HOLDING B.V., Eindhoven (NL)

(72) Inventors: Berent Willem Meerbeek, Eindhoven (NL); Kars-Michiel Hubert Lenssen, Eindhoven (NL); Petrus Johannes Hendrikus Seuntiens, Eindhoven (NL); Johannes Petrus Wilhelmus Baaijens, Eindhoven (NL); Jochen Renaat Van Gheluwe, Eindhoven (NL); Bart Kroon, Eindhoven (NL); Evert Jan Van Loenen, Eindhoven (NL); Philip Steven Newton, Eindhoven (NL); Ramon Antoine Wiro Clout, Eindhoven (NL)

(73) Assignee: PHILIPS LIGHTING HOLDING B.V., Eindhoven (NL)

( * ) Notice: Subject to any disclaimer, the term of this patent is extended or adjusted under 35 U.S.C. 154(b) by 0 days.

(21) Appl. No.: 15/109,046

(22) PCT Filed: Dec. 19, 2014

(86) PCT No.: PCT/EP2014/078615
§ 371 (c)(1),
(2) Date: Jun. 29, 2016

(87) PCT Pub. No.: WO2015/104164
PCT Pub. Date: Jul. 16, 2015

(65) Prior Publication Data

US 2016/0320023 A1 Nov. 3, 2016

(30) Foreign Application Priority Data

Jan. 7, 2014 (EP) ..... 14150309

(51) Int. Cl.
*F21V 7/00* (2006.01)
*F21V 9/02* (2006.01)
(Continued)

(52) U.S. Cl.
CPC ..... *F21V 9/02* (2013.01); *F21V 3/00* (2013.01); *F21V 9/08* (2013.01); *F21V 14/003* (2013.01);
(Continued)

(58) Field of Classification Search
CPC ..... F21V 14/003; F21V 14/006; F21V 14/04; F21V 14/06; F21V 14/08; F21V 23/003;
(Continued)

(56) References Cited

U.S. PATENT DOCUMENTS 7,940,457 B2 * 5/2011 Jain ..... E06B 9/24 349/16
2007/0058114 A1 * 3/2007 Niiyama ..... G02F 1/13 349/106
(Continued)

FOREIGN PATENT DOCUMENTS

WO 2008149250 A1 12/2008
WO 2011107896 A1 9/2011
(Continued)

*Primary Examiner* — Ali Alavi

(57) ABSTRACT

A lighting system comprises a light source having an exit window and an electrically controllable light processing arrangement, in the form of a grid of cells lying in a plane parallel to the exit window. Each cell has a cell wall formed as electrically switchable element which is switchable between at least two processing modes. The cell wall surrounds an opening, such that light emitted in a normal direction from the light source exit window is not processed, and light passing at an angle to the normal direction greater than a threshold angle is processed by the cell wall for color and/or intensity control.

15 Claims, 6 Drawing Sheets

(51) Int. Cl.

| | |
|---|---|
| ***H05B 33/08*** | (2006.01) |
| ***F21V 3/00*** | (2015.01) |
| ***F21V 9/08*** | (2006.01) |
| ***F21V 14/00*** | (2006.01) |
| ***F21V 23/00*** | (2015.01) |
| ***F21V 33/00*** | (2006.01) |
| *F21Y 115/10* | (2016.01) |
| *F21Y 115/15* | (2016.01) |

(52) U.S. Cl.
CPC ..... *F21V 23/003* (2013.01); *F21V 33/006* (2013.01); *H05B 33/0857* (2013.01); *F21Y 2115/10* (2016.08); *F21Y 2115/15* (2016.08)

(58) Field of Classification Search
CPC ..... F21V 9/02; F21V 9/08; F21Y 2115/10; H05B 33/0857
See application file for complete search history.

(56) References Cited

U.S. PATENT DOCUMENTS

| | | | | |
|---|---|---|---|---|
| 2009/0103296 | A1* | 4/2009 | Harbers ..... | F21V 7/22 362/234 |
| 2011/0038030 | A1* | 2/2011 | Roosendaal ..... | E06B 9/24 359/296 |

FOREIGN PATENT DOCUMENTS

| | | | |
|---|---|---|---|
| WO | 2012140579 | A2 | 10/2012 |
| WO | 2013011404 | A2 | 1/2013 |
| WO | 2013011410 | A1 | 1/2013 |
| WO | 2013011481 | A2 | 1/2013 |
| WO | 2013050918 | A1 | 4/2013 |
| WO | 2013057610 | A1 | 4/2013 |
| WO | 2013150429 | A1 | 10/2013 |

* cited by examiner

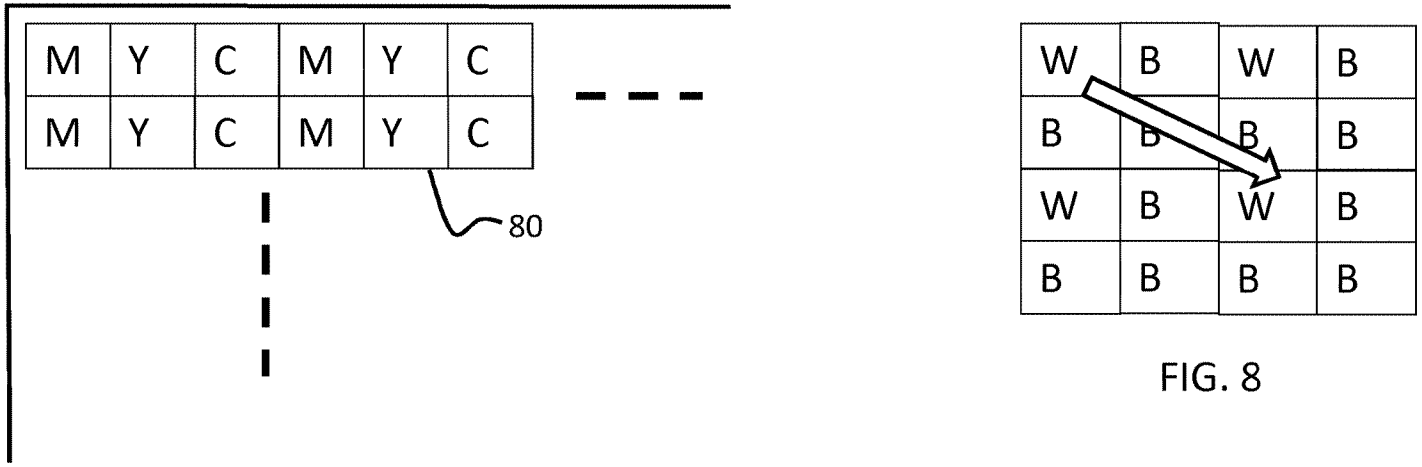
FIG. 7
FIG. 8
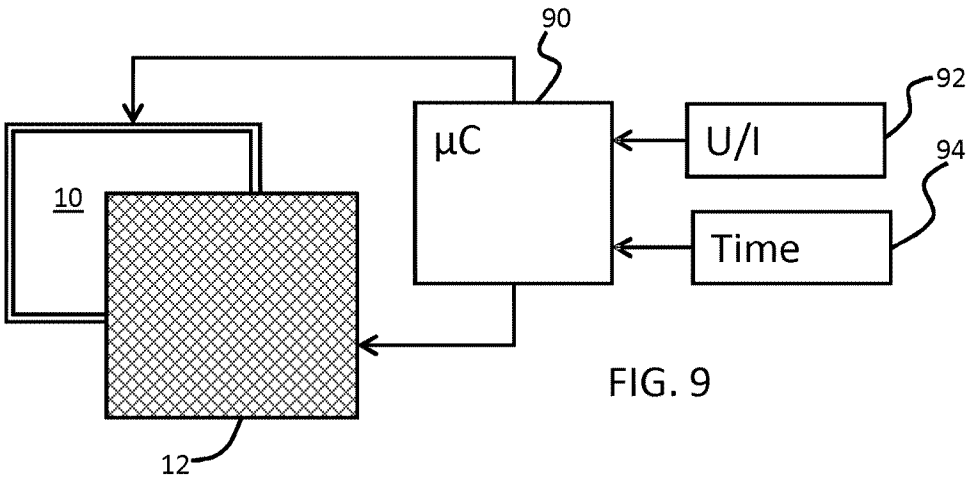
FIG. 9

LIGHTING SYSTEM

CROSS-REFERENCE TO PRIOR APPLICATIONS

This application is the U.S. National Phase application under 35 U.S.C. §371 of International Application No. PCT/EP2014/078615, filed on Dec. 19, 2014, which claims the benefit of European Patent Application No. 14150309.4, filed on Jan. 7, 2014. These applications are hereby incorporated by reference herein.

FIELD OF THE INVENTION

This invention relates to interior lighting systems.

BACKGROUND OF THE INVENTION

People generally prefer daylight over artificial light as their primary source of illumination. Everybody recognizes the importance of daylight in our daily lives. Daylight is known to be important for people's health and well-being.

In general, people spend over 90% of their time indoors, and often away from natural daylight. There is therefore a need for artificial daylight sources that create convincing daylight impressions with artificial light, in environments that lack natural daylight including homes, schools, shops, offices, hospital rooms, and bathrooms.

There has been significant development of lighting systems which try to emulate daylight even more faithfully. For example, such lighting systems are used as artificial skylights, which attempt to emulate natural daylight that would be received through a real skylight. To enhance the realism of the artificial skylight, the skylight solution is usually mounted in a recess in the ceiling, in the same way that a real skylight would be mounted.

It has been recognized that it would be desirable to enable the color temperature to be selectable or even to evolve over time, so that the evolution of the color point of natural daylight can be emulated, or indeed a specific color point can be selected. However, this requires a more complex light source and associated control system.

There is therefore a need for a light system which enables control of the color point in a more efficient and cost effective manner.

SUMMARY OF THE INVENTION

The invention is defined by the claims.

According to the invention, there is provided a lighting system comprising:

a light source having an exit window; and an electrically controllable light processing arrangement, wherein the electrically controllable processing arrangement comprises a grid of cells lying in a plane parallel to the exit window, each cell having a cell wall formed as electrically switchable element which is switchable between at least two processing modes, wherein the cell wall surrounds an opening, such that light emitted in a normal direction from the light source exit window is not processed, and light passing at an angle to the normal direction greater than a threshold angle is processed by the cell wall.

This arrangement uses a grid of cells to provide a light processing function. The cell walls provide the light processing, and they extend in the direction normal to the light exit window. This means the cell walls only perform their light processing function on light emitted at an angle to the normal. In this way, they can be used to control the light perceived as ambient light, without affecting the direct (downward) illumination, which can be task light to a workstation.

The light processing arrangement can comprise an electrically controllable filter or reflector. The filter can be used to change the color of the large-angle light, or else a reflector can be used to change the intensity. These two possibilities can of course be combined.

The at least two modes can comprise modes which provide different color light output for light passing at an angle to the normal direction greater than the threshold angle. For example, the light can be controlled to have different blue components. By providing a bluer appearance, the light source can give a more natural impression, replicating the sky color, but still provide bright direct task light.

The at least two modes can comprise modes which provide different light intensity output for light passing at an angle to the normal direction greater than the threshold angle. This can be used to provide controllable general lighting level, while maintaining bright direct task light.

In one arrangement, the cells can contain electrically charged particles which perform a filtering function, and the particles are adapted to move within the cell wall between an in-view area and a reservoir area. In this arrangement, the particles either provide color filtering, when the particles are within the cell area, or provide a transparent mode when the particles are contained within the cell walls.

Each cell comprises a single color filter. This is sufficient to provide control of the level of blue content of the general lighting, for example. However, each cell can comprise a multiple color filter. This can be used to mimic different sky conditions, such as clear sky, overcast sky, sunrise or sunset.

One way to provide color control is for each cell to comprise at least two different types of charged color particle which are independently movable between an in-view area and a reservoir area.

An alternative is for each cell to comprise a set of sub-walls side-by-side in the plane which is parallel to the exit window, wherein each sub-wall comprises an electrically switchable filter for a different color. Alternatively, each cell can comprise a set of sub-walls stacked in the direction normal to the exit window, wherein each sub-wall comprises an electrically switchable filter for a different color. These arrangements enable full color control.

For example, the set of sub-walls can comprise a first sub-wall with a yellow color subtractive filter, a second sub-wall with a magenta color subtractive filter and a third sub-wall with a cyan color subtractive filter.

The cells can all be controlled in the same way, which enables a simple control scheme. However, the grid of cells can instead comprise independently controllable regions. This enables dynamic effects to be created.

For example, a first type of cell can provide a first color filtering function and a second type of cell can provide a second color filtering function, and wherein the light source has independently controllable regions associated with the different types of cell. This arrangement enables color filtering, but with the individual cells only needing a single color filter arrangement.

The lighting system can comprise an artificial daylight luminaire.

BRIEF DESCRIPTION OF THE DRAWINGS

Examples of the invention will now be described in detail with reference to the accompanying drawings, in which:

FIG. 7 shows how an array of different color filtering cells may be formed;

FIG. 8 shows how the color filter arrangement can be controlled dynamically; and FIG. 9 shows the lighting system with associated controller.

DETAILED DESCRIPTION OF THE EMBODIMENTS

The invention provides a lighting system comprising a light source having an exit window and an electrically controllable light processing arrangement, in the form of a grid of cells lying in a plane parallel to the exit window. Each cell has a cell wall formed as an electrically switchable element which is switchable between at least two processing modes. The cell wall surrounds an opening, such that light emitted in a normal direction from the light source exit window is not processed, and light passing at an angle to the normal direction greater than a threshold angle is processed by the cell wall for color and/or intensity control.

The light emitted at angles greater than the threshold angle can give a general ambient illumination, whereas the normally emitted light can provide direct task light. The threshold is for example 35 degrees to the normal. For example, for a 2.5 m high ceiling, an angle 35 degrees each side of the normal gives a 3.5 m diameter floor area which can be considered to be illuminated with task light. The rest of the room is bathed in light from greater angles. More narrowly directed task light will correspond to a smaller angle threshold.

Figure 1:
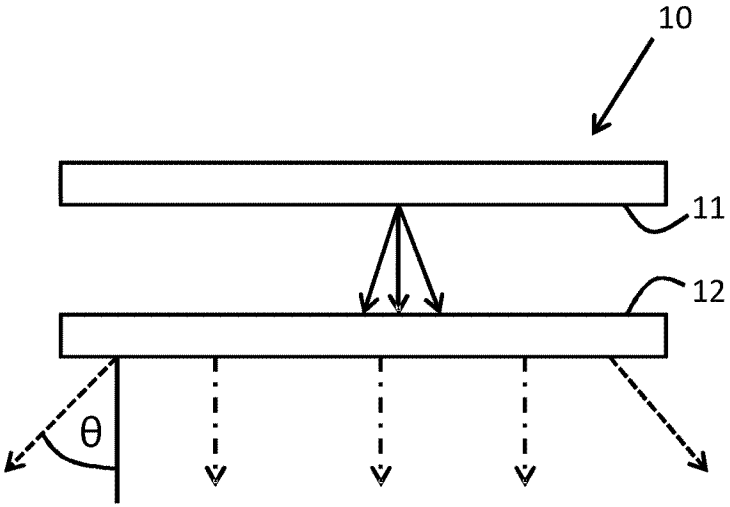
FIG. 1 shows a lighting system of the invention.

FIG. 1 shows a lighting system of the invention, comprising a diffuse light source 10 and an electrically controllable light processing arrangement 12 through which the output of the light source is provided. The light source 10 has a planar exit window 11, which is typically mounted parallel to a surface in which the lighting system is mounted, and typically parallel to a horizontal ceiling.

The light processing preferably comprises color filtering. This can be based on color subtraction (for example with filter elements that absorb a certain light spectrum), or reflection of certain colors (for example with filter elements that reflect a certain light spectrum). However, the light processing can instead comprise intensity control, by selected absorption or reflection of the full light spectrum.

In the preferred arrangement having color filtering, the filter arrangement 12 is for providing controllable differences in color between light directed in a normal direction (i.e. downward in the case of a ceiling mounted light source) and at an angle to the normal. The term "normal direction" is used in the mathematical context, as meaning perpendicular to plane of the light exit window. This is represented schematically in FIG. 1, by the different arrow types used to show normal light and angled light. The threshold angle mentioned above is shown in FIG. 1 as θ, and it may be 35 degrees. For light emitted from the center of the cell area the light does not pass through the cell wall within this angle each side of the normal. Of course, if the light source is a continuous sheet of illumination, for locations near the edge of the cell opening, even shallow angles of light will pass through the cell wall.

The color filter comprises a grid of filter cells switchable between at least two filter modes.

Figure 2:
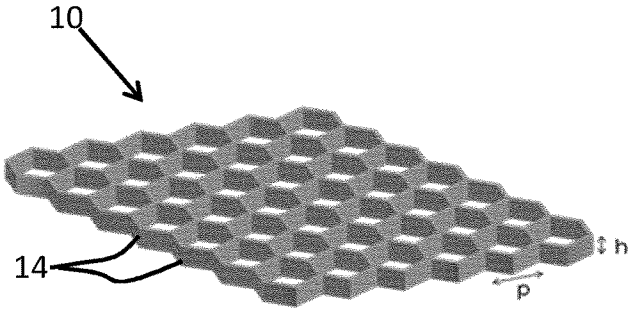
FIG. 2 shows an example of the structure of the light processing arrangement.

FIG. 2 shows an example of the structure of the color filter arrangement 12. A grid of hexagonal cells 14 is provided.

The cells 14 lie in a plane parallel to the exit window, each cell having a cell wall formed as electrically switchable element which is switchable between at least two processing modes. Each cell wall surrounds an opening, such that light emitted in a normal direction from the light source exit window 11 is not processed, and light passing at an angle to the normal direction greater than the threshold angle must pass through the cell wall.

The steepest angle of light which is not processed will be defined between one edge of the light source and a diametrically opposite cell wall. This angle can be considered to be the angle which determines if threshold angle is reached, since all light steeper than this angle must pass through a cell side wall.

In a preferred arrangement, the cell walls are formed as electrophoretic color filters. In this case, based on the movement of colored absorbing particles, each cell is able to dynamically adjust the color of light passing through the cell wall. As a result, the apparent color of the sky surface can be changed to mimic different skies. For example, depending on the color filtering used, the system can emulate a sunset sky, a clear sky, an overcast day, etc.

The grid typically can have a height h of 1-15 mm and a cell pitch p of 1 to 10 mm, and the grid can be hexagonal as shown, but it may instead be square or rectangular.

The cell pitch and height are chosen so that light from a center of the cell, and within a first range of angles to the normal direction, passes through the central area of the grid cells, such as 0 to 35 degrees, whereas steeper light, from 35 to 90 degrees, passes through the cell walls. The cell wall design can be chosen to make the task light narrower (e.g. 25 degrees) or wider.

Electrophoretic display devices are well known, and are for example widely used in e-book readers.

Electrophoretic display devices use the movement of particles within an electric field to provide a selective light transmission or light blocking function. The particles can be light blocking or they can be color filtering, performing a subtractive color filter function. Multiple different subtractive color filter arrangements can be stacked to enable full color control. The known display device configuration can be used as a color filter, when used in combination with a light source.

An electrophoretic display can make use of transverse or in-plane electric fields.

For example, in the case of a transverse electric field device, the electric field can be used to bring the colored particles to the surface of the device so that they are seen. Alternatively, an underlying layer may have colored regions, and the particles may then block the passage of light to the underlying color or else permit this passage of light.

Another type of electrophoretic display device uses so-called "in plane switching". This type of device uses movement of the particles selectively laterally in the display material layer. When the particles are moved towards lateral electrodes, an opening appears between the particles, through which an underlying surface can be seen. When the particles are randomly dispersed, they block the passage of light to the underlying surface and the particle color is seen. In the case of an e-book reader, the particles are typically colored and the underlying surface black or white, or else the particles can be black or white, and the underlying surface colored. However, the particles can instead be color filtering particles for the application to this invention.

An advantage of in-plane switching is that the device can be adapted for transmissive operation. In particular, the movement of the particles creates a passageway for light, so that both transmissive and color filtering operation can be implemented through the material.

It has been recognized that electrophoretic technology enables low power consumption and thin devices to be formed. They may also be made from plastics materials, and there is also the possibility of low cost reel-to-reel processing in the manufacture of such devices.

The cell walls of the structure shown in FIG. 2 can be structured as an in-plane electrophoretic device—with the plane extending in the direction normal to the exit window. Thus, particle movement in the plane is then upwardly or downwardly. This will be clear from the detailed examples below.

In a simplest implementation, arrays of electrophoretic cells can be controlled with all cells controlled in the same way, or with cells grouped into a relatively small number of segments.

Arrays of electrophoretic cells can instead be controlled independently using a passive matrix addressing scheme. A problem associated with the use of passive matrix addressing is that the driving signals must be introduced sequentially, typically one line at a time, along (orthogonal) selection rows and data columns. Once the line is no longer being addressed, the electrical field is reduced to a level whereby the particles will not move. As a consequence, the particles only move whilst a line is addressed, and it will take a long time to complete the addressing (in general, the response speed of the pixel times the number of rows in the display). As the device operates using the physical movement of particles, there is a limit to the speed at which a pixel can be addressed.

For the application of this invention, it may be sufficient for all cells of the grid to be controlled in the same way, so that a simple addressing scheme can be used.

However, the refresh time is not likely to be an issue, since the light output only needs to evolve slowly over time. Thus, passive matrix addressing can be used, as a low cost and low power consumption implementation which nevertheless enables different areas of the array of cells to be controlled independently.

It is also known to use active matrix addressing, which ensures that the driving voltage is maintained during the time that other lines of the display are being selected, and also provides electrical isolation of pixels from the signal lines when not being addressed. In an active matrix arrangement, switching elements such as diodes or transistors can be used, either alone or in conjunction with other elements, to cell electrodes. Active matrix addressing can also be used.

A number of detailed examples will now be given. In FIGS. 3 to 6, the structure of a single cell is shown for simplicity. In all examples, the light processing is based on an electrophoretic approach.

These figures are not drawn to scale. In particular, they are drawn much wider to make the structure clear. This means the ray directions are not meant to be accurate.

Figure 3B:
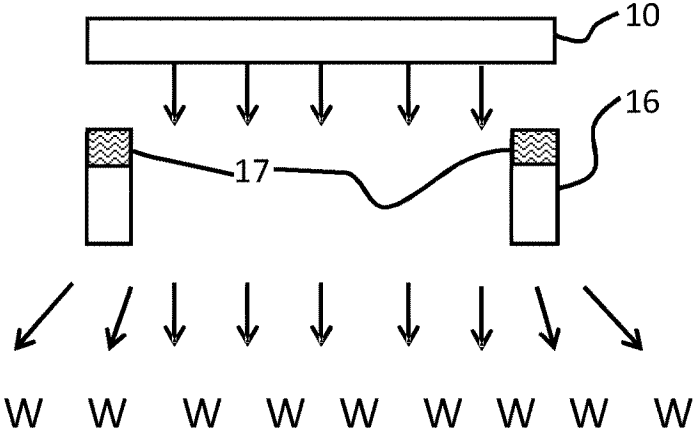
FIG. 3*b* shows a first more detailed example of a light processing arrangement providing controllable color filtering when the particles are shielded from the light source output.
Figure 3A:
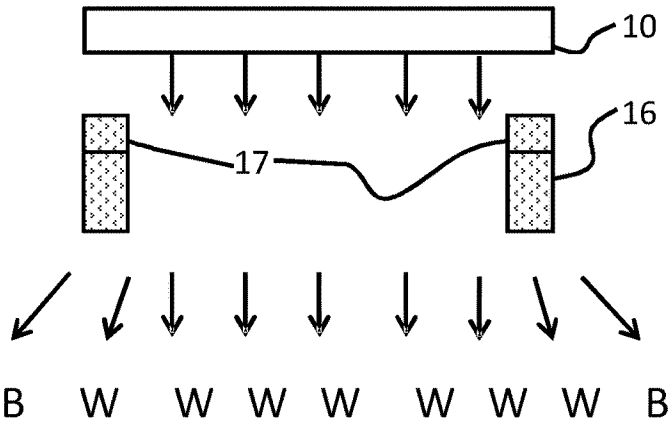
FIG. 3*a* shows a first more detailed example of a light processing arrangement providing controllable color filtering when the particles are within the side wall of the cell.

FIG. 3 shows a first example.

Light controlling particles are provided in the side walls 16 (only). The central area of the cell is transparent, so that there is always white task light emitted in the normal direction (assuming the light source 10 emits white light). The particles can then be adapted to move between a uniform distribution within the side walls and a reservoir area 17, to switch between first and second modes. For example, the reservoir area 17 can be at the top of the cell wall (i.e. nearest the light source 10).

The reservoir walls can be light blocking. This arrangement is shown in FIG. 3 with the two extreme states.

In this arrangement, the particles either provide color filtering for light emitted at an angle to a normal direction, when the particles are within the side walls (FIG. 3(*a*)), or the particles are shielded from the light source output (FIG. 3(*b*)). In one preferred example, the color of the cell walls 16 can be adjusted from blue to transparent, as shown in FIG. 3 (wherein B=blue and W=white).

Blue color filtering can be achieved using absorption of yellow light through a translucent medium or reflection of blue light through an opaque/scattering medium. Typically, the translucent option is preferred for efficiency reasons.

The control of the blue light content at large angles enables two modes to be created, comprising a first, daylight, mode which provides an output with a greater large-angle blue component than a second, artificial lighting, mode.

The cells comprise electrodes placed in the outer walls. When no potential is applied to the electrodes the colored particles are evenly distributed across the cell area and the apparent color is controlled (such as blue in this example). When a potential is applied with the opposite charge of the colored particles, the particles will move towards the reservoir electrode resulting in the rest of the grid being without colored particles. As a result, it will appear transparent and the blue sky appearance is gone.

In a simplest implementation, all cells walls in the grid behave in the same way. FIG. 3 shows a single reservoir area 17 and a single color filtering area. In practice, a cell way can consist of several substructures with reservoirs and filtering areas. For example the cell side wall may be divided into sections (six for a hexagonal grid) and each cell wall section can be a separate reservoir and chamber structure.

Figure 4B:
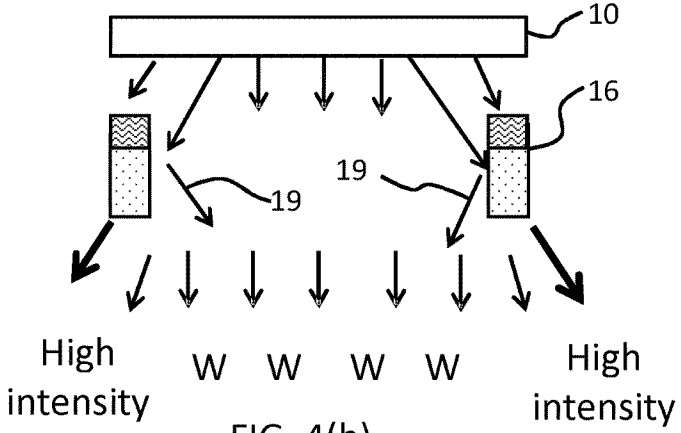
FIG. 4*b* shows a second more detailed example of a light processing arrangement providing controllable intensity control wherein the cell walls are controlled to be less reflective.
Figure 4A:
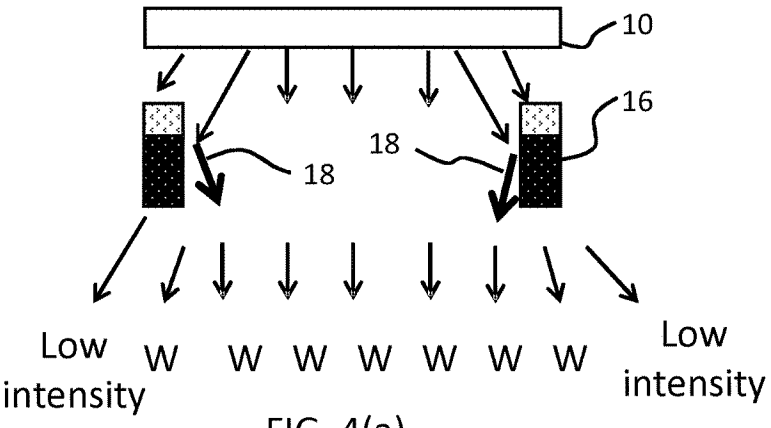
FIG. 4*a* shows a second more detailed example of a light processing arrangement providing controllable intensity control wherein the cell wall is controlled to be highly reflective.

FIG. 4 shows a second example.

The opacity of the cell walls can be adjusted from opaque to transparent. This essentially provides intermediate states to the example of FIG. 3 to provide different degrees of light filtering. The density of reflecting particles in the cell wall can be used to determine how much light is reflected back towards the light source and how much is transmitted.

FIG. 4(*a*) shows the cell wall controlled to be highly reflective so that a lesser amount of light reaches larger lateral angles. The large amount of reflection at the side walls is shown as arrows 18.

FIG. 4(*b*) shows the cell wall controlled to be less reflective so that a greater amount of light reaches larger lateral angles. The smaller amount of reflection at the side walls is shown as arrows 19.

The filtering function can provide both color control and intensity control, or it may provide only intensity control, for example by controlling the movement of fully (white) reflecting particles, or black absorbing particles.

The examples above provide filtering of the light in lateral directions, for example to provide control of the amount of blue content for that laterally directed light. However, further embodiments allow the optical grid to be controlled to provide various color outputs, such as yellow, orange and red, for example. This allows simulation of a sunset or sunrise, for example.

Figure 5B:
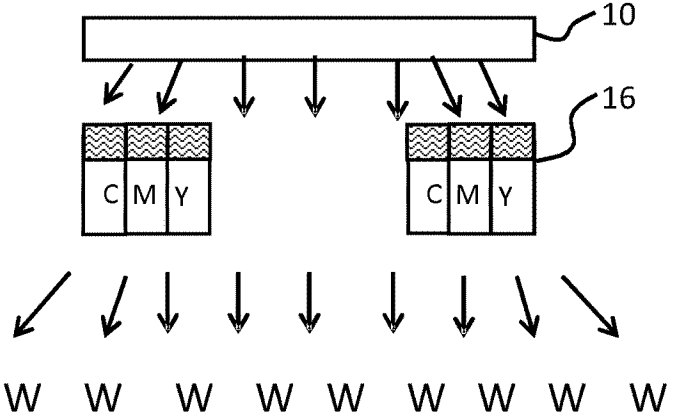
FIG. 5*b* shows a third more detailed example of a light processing arrangement wherein the cell walls have been made transparent so that white light is provided in all directions.
Figure 5A:
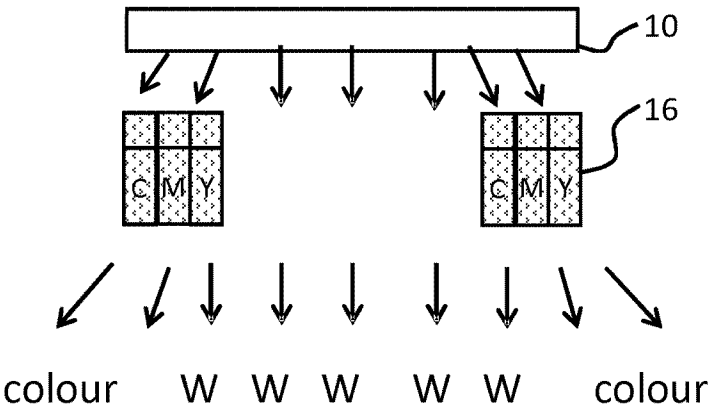
FIG. 5*a* shows a third more detailed example of a light processing arrangement wherein a desired color output is being generated.

A third example is shown in FIG. 5, which enables greater control of the color directed to larger lateral angles.

In this example, each cell wall consists of three layers (Cyan (C), Magenta (M) and Yellow (Y)). As shown, these three layers are stacked laterally. Thus, each cell comprises a set of sub-walls side-by-side in the plane parallel to the exit window, wherein each sub-wall comprises an electrically switchable filter for a different color.

By switching their individual states, various colors can be created. Note that the grid width will be much thinner than as shown in FIG. 5, so that at larger angles, the white light beam from light source 10 travels through all three of the C, M, and Y filters.

Depending on the state of C, M, Y filters, the final color output will change.

FIG. 5(*a*) shows a desired color output being generated, and FIG. 5(*b*) shows the cell walls made transparent so that white light is provided in all directions.

FIG. 5 shows laterally stacked color filters forming the cell walls.

Figure 6B:
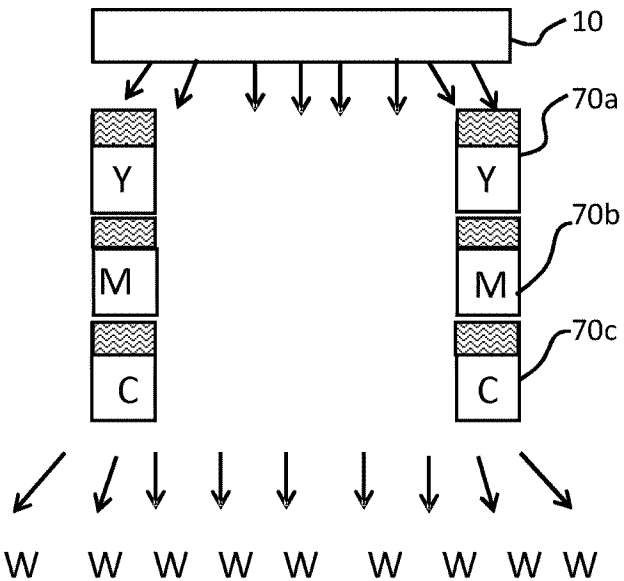
FIG. 6*b* shows a fourth more detailed example of a light processing arrangement wherein the filters are controlled to allow white light to pass through all angles.
Figure 6A:
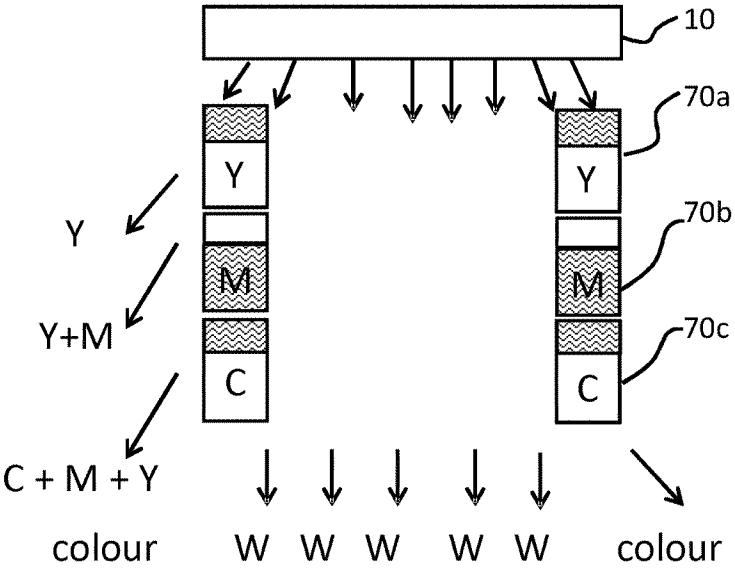
FIG. 6*a* shows a fourth more detailed example of a light processing arrangement wherein the filters are being controlled to give a desired color output.

FIG. 6 shows a fourth example, in which the color filters are vertically stacked.

In this case, the set of sub-walls comprises a set of sub-walls stacked in the direction normal to the exit window, wherein each sub-wall comprises an electrically switchable filter for a different color.

In the example shown, the yellow color filter 70*a* is closest to the light source 10, the magenta color filter 70*b* is stacked over the yellow color filter 70*a* (wherein "over" is used with reference to the location of the light source) and the cyan color filter 70*c* is stacked over the magenta color filter 70*b*.

In this way, the cell walls consist of stacked segments, each with a different color. The white light emitted to large angles only travels through the yellow segment, slightly smaller angles also pass through the magenta segment, and even smaller angles also pass through the cyan segment. Directly under the light source, the light output remains unfiltered.

FIG. 6(*a*) shows the filters controlled to give a desired color output, by selecting the magenta color filter. At very large angles, near parallel to the ceiling, the light misses the magenta filter and will still appear white. However, for light of lower angles θ, color control is implemented.

FIG. 6(*b*) shows the filters controlled to allow white light to pass through all angles.

FIGS. 5 and 6 thus show color subtractive filtering. A cyan filter absorbs red light, a magenta filter absorbs green light and a yellow filter absorbs blue light. For example, cyan and magenta filters are used to obtain blue light from the white light source. Yellow and magenta filters are used to obtain red light from the white light source.

The stacking of multiple layers of different color in the grid walls in the example of FIG. 6 gives further directional control of the color perceived at different locations in a room. Further away from the light source, the color mixing will be better than under or near the lamp. This could be used to make the grid appear more bluish close to the lamp (with filtering through the cyan and magenta filters) and more reddish further away (with filtering through the magenta and yellow filters).

FIGS. 5 and 6 provide three color filters for color control. More limited dynamic colored effects can of course be created by using only two different filter colors. It is known that control of two color filters can be achieved with a single electrophoretic cell, by providing two different types of charged particles, which can be controlled independently.

Instead of using multiple switchable electrophoretic particles within each cell, in order to provide color control, the grid may also be composed of grid segments of different colors. These can then be operated depending on the time of day. The light sources can then also comprise an array of light sources, such as LEDs, and these can also be controlled independently. Thus, for generating a red output at large angles, dimming of some of the other segments can be carried out while providing a red output at large lateral angles for the light sources which are not dimmed.

FIG. 7 schematically shows the color filter grid formed as an array of different color cells 80.

By controlling segments of the optical grid individually, they can have a different color and/or opacity. In this way, gradients in the sky can be created. For example, dynamic clouds in the sky can be simulated by switching certain segments of the grid from blue to white and vice versa in a time-dependent sequence. This approach is shown in FIG. 8, in which the arrow shows how a white region can move across the light output area.

The independently controllable regions can comprise individual cells, or else sub-arrays of cells.

In most examples above, the cell walls provide a translucent color filtering function. The cells walls can process the light for steeper angles by a controlled degree of reflection. The side walls can be opaque in this case. Thus, the steep light provided to one side is reflected light from an opposite side of the cell, and the color and/or intensity of this steep light can be controlled by varying the reflection characteristics of the cell wall.

The side walls thus generally perform a light processing function, which may comprise a translucent filtering function or a reflective filtering function.

FIG. 9 shows a system of the invention. A controller 90 controls the light source 10 as well as the color filtering arrangement 12. The controller can operate according to user instructions received from a user interface 92 and/or based on a time value received from a timer 94 so that sun rise and sun set control can be provided automatically. The controller enables changes in the light output of the light source to be synchronized with changes in the color filtering function.

The controller can be implemented in numerous ways, with software and/or hardware, to perform the various functions required. A processor is one example of a controller which employs one or more microprocessors that may be programmed using software (e.g., microcode) to perform the required functions. A controller may however be implemented with or without employing a processor, and also may be implemented as a combination of dedicated hardware to perform some functions and a processor (e.g., one or more programmed microprocessors and associated circuitry) to perform other functions.

Examples of controller components that may be employed in various embodiments of the present disclosure include, but are not limited to, conventional microprocessors, application specific integrated circuits (ASICs), and field-programmable gate arrays (FPGAs).

In various implementations, a processor or controller may be associated with one or more storage media such as volatile and non-volatile computer memory such as RAM, PROM, EPROM, and EEPROM. The storage media may be encoded with one or more programs that, when executed on one or more processors and/or controllers, perform at the required functions. Various storage media may be fixed within a processor or controller or may be transportable, such that the one or more programs stored thereon can be loaded into a processor or controller.

The examples above are based on the technology of electrophoretic displays. Various designs of electrophoretic display, which can be used to provide the color filtering function of the invention, are well known. For example, the article "Bright e-skin technology and applications: Simplified grey-scale e-paper" by K.-M. H. Lenssen et. al., discloses suitable designs in detail. This paper is published in The Journal of the SID, 19/1, 2011.

In general, the particles in such a device do not need to move over distances as large as 1 mm, so typically not over whole height of the grid walls. Instead substructures can be used so that particles have to move for example only 100 to a few hundred microns to reach a reservoir.

Electrophoresis is not the only possible electrically controllable filter technology. Other techniques to change the color of the grid can be used, including electrochromic control, suspended particle devices, electrowetting techniques, and liquid crystal filters.

The invention provides an arrangement in which for smaller angles (directly under the luminaire) there is no filtering of the light, which remains white. For larger angles, various different light processing options are available, as described above.

The light source can take many different forms. By way of example, the light source 10 can comprise an edge lit light guide with an out-coupling pattern on its surface (such as paint dots, or surface roughness) or scattering particles or structures formed within its structure. The light source can be LEDs at one or more edges of a lightguide structure. As a second example, the light source can be an OLED (organic LED) lighting panel. As a third example, the light source can consist of an array of low or medium power LEDs in a white mixing box. The mixing box is covered by a diffuser to create a homogeneous emitting surface.

A weak diffuser can be provided at the final exit window of the skylight (after the cell grid) with the main purpose to make the grid structure invisible.

Other variations to the disclosed embodiments can be understood and effected by those skilled in the art in practicing the claimed invention, from a study of the drawings, the disclosure, and the appended claims. In the claims, the word "comprising" does not exclude other elements or steps, and the indefinite article "a" or "an" does not exclude a plurality. The mere fact that certain measures are recited in mutually different dependent claims does not indicate that a combination of these measured cannot be used to advantage. Any reference signs in the claims should not be construed as limiting the scope.

The invention claimed is:

1. A lighting system comprising:

a light source having an exit window; and an electrically controllable light processing arrangement, wherein the electrically controllable processing arrangement comprises a grid of cells lying in a plane parallel to the exit window, each cell having a cell wall formed as electrically switchable element which is switchable between at least two processing modes, wherein the cell wall surrounds an opening, such that light emitted in a normal direction from the light source exit window is not processed, and light passing at an angle to the normal direction greater than a threshold angle is processed by the cell wall.

2. A lighting system as claimed in claim 1, wherein the light processing arrangement comprises an electrically controllable filter or reflector.

3. A lighting system as claimed in claim 1, wherein the at least two modes comprise modes which provide different color light output for light passing at an angle to the normal direction greater than the threshold angle.

4. A lighting system as claimed in claim 3, wherein the at least two modes comprise a first mode which provides a filtered output with a first blue component and a second mode which provides a filtered output with a different second blue component.

5. A lighting system as claimed in claim 1, wherein the at least two modes comprise modes which provide different light intensity output for light passing at an angle to the normal direction greater than the threshold angle.

6. A lighting system as claimed in claim 1, wherein the cells contain electrically charged particles which perform a filtering function, and the particles are adapted to move within the cell wall between an in-view area and a reservoir area.

7. A lighting system as claimed in claim 1, wherein each cell comprises a single color filter.

8. A lighting system as claimed in claim 1, wherein each cell comprises a multiple color filter.

9. A lighting system as claimed in claim 8, wherein each cell comprises at least two different types of charged color particle which are independently movable between the in-view area and the reservoir area.

10. A lighting system as claimed in claim 8, wherein each cell comprises a set of sub-walls side-by-side in the plane parallel to the exit window, wherein each sub-wall comprises an electrically switchable filter for a different color.

11. A lighting system as claimed in claim 8, wherein each cell comprises a set of sub-walls stacked in the direction normal to the exit window, wherein each sub-wall comprises an electrically switchable filter for a different color.

12. A lighting system as claimed in claim 10, wherein the set of sub-walls comprises a first sub-wall with a yellow color subtractive filter, a second sub-wall with a magenta color subtractive filter and a third sub-wall with a cyan color subtractive filter.

13. A lighting system as claimed in claim 1, wherein the grid of cells comprises independently controllable regions.

14. A lighting system as claimed in claim 13, wherein the grid of cells comprises a first type of cell providing a first color filtering function and a second type of cell providing a second color filtering function, and wherein the light source has independently controllable regions associated with the different types of cell.

15. A lighting system as claimed in claim 1, comprising an artificial daylight luminaire.

* * * * *